US007099488B2

(12) United States Patent
Bohlender

(10) Patent No.: US 7,099,488 B2
(45) Date of Patent: Aug. 29, 2006

(54) PLANAR SPEAKER WIRING LAYOUT

(75) Inventor: Jack T. Bohlender, Carson City, NV (US)

(73) Assignee: Wisdom Audio Corp, Carson City, NV (US)

( * ) Notice: Subject to any disclaimer, the term of this patent is extended or adjusted under 35 U.S.C. 154(b) by 113 days.

(21) Appl. No.: 10/275,449

(22) PCT Filed: May 3, 2001

(86) PCT No.: PCT/US01/14199

§ 371 (c)(1),
(2), (4) Date: Jul. 17, 2003

(87) PCT Pub. No.: WO01/84883

PCT Pub. Date: Nov. 8, 2001

(65) Prior Publication Data

US 2004/0022410 A1 Feb. 5, 2004

Related U.S. Application Data

(60) Provisional application No. 60/201,401, filed on May 3, 2000.

(51) Int. Cl.
*H04R 1/00* (2006.01)

(52) U.S. Cl. ..... 381/408; 381/423

(58) Field of Classification Search ..... 381/150, 381/152, 396, 398, 399, 408, 412, 421, 423, 381/431, 409

See application file for complete search history.

(56) References Cited

U.S. PATENT DOCUMENTS 3,674,946 A * 7/1972 Winey ..... 381/408
3,919,499 A 11/1975 Winey
4,037,061 A 7/1977 von Recklinghausen
4,210,786 A * 7/1980 Winey ..... 381/408
4,338,489 A * 7/1982 Gorike ..... 381/117
4,468,530 A 8/1984 Torgeson
4,653,103 A * 3/1987 Mori et al. ..... 381/408
5,003,609 A 3/1991 Muraoka
5,297,214 A 3/1994 Bruney
5,953,438 A 9/1999 Stevenson et al.
6,104,825 A * 8/2000 Thigpen ..... 381/408

FOREIGN PATENT DOCUMENTS

EP 0 996 311 A1 4/2000

OTHER PUBLICATIONS

PCT Written Opinion.

* cited by examiner

*Primary Examiner*—Sinh Tran
*Assistant Examiner*—Brian Ensey
(74) *Attorney, Agent, or Firm*—Patent Law Offices of Rick Martin, PC

(57) ABSTRACT

Trace runs for Planar Line Source Transducers (or speakers) are separated into multiple trace circuits which are electrically isolated but occupy the same area on the planar film. The separate trace runs are then driven with different electrical signals with tailored spectral content in order to achieve an overall acoustical frequency response. By having the separate trace runs occupy the same area, the line source nature of the transducer is preserved over the entire intended spectral response of the transducer and the mechanical structure is also kept simple. External spectral filtering circuits are used to pre-shape the spectral signal into each individual trace run and in most cases, the filtering components are passive and inexpensive.

6 Claims, 6 Drawing Sheets

PLANAR SPEAKER WIRING LAYOUT

CROSS REFERENCE TO RELATED APPLICATIONS

This application is a national phase application of PCT/US01/14199 which was filed on May 3, 2001 and claimed priority from U.S. provisional application No. 60/201,401 which was filed on May 3, 2000.

FIELD OF INVENTION

This invention relates to transducers which convert electrical energy into acoustical energy, one application being planar line source loudspeakers

BACKGROUND OF THE INVENTION

Planar transducers (also referred to as speakers) have a film composed of mylar, polyester, kapton, etc, suspended between rows of fixed magnetic bars composed of ceramic, neodymium(a rare earth), etc. Electronic signals carrying the sound to be generated are sent through the wires imbedded in the film. The variable magnetic fields created by the thin wires interact with the nearby fixed magnets to vibrate the film, thereby creating sound waves. They are similar to electrostatic speakers only in that thin film propagates the sound waves. Electrostatics don't use magnets, but create a magnetic field by reciprocating the field back and forth through high voltage stators via a transformer. A planar can handle much more power and produce higher sound pressure levels (SPL). The best version of a planar is a Line Source type. A "Line Source" version planar is narrow in width and very long compared to its width. This produces a cylindrical pattern, yielding enormous lateral coverage and almost no directionality above or below the ends of the driver. They also are very rugged and present an almost purely resistive load to the amplifier. Line source speakers can also handle a lot of power as the relatively large area of film results in a large distribution of the power. Developed many years ago, they have recently become more popular with the advent of high power magnets, durable thin films, advanced adhesives to hold the aluminum traces to the film, sturdier metals for lighter framework, and tensioning techniques. No other speaker design offers the low distortion, excellent coverage, even dispersion, limited ceiling-floor reflections, and high SPL's as does a Planar Line Source.

Higher frequency audio components are more directional, and it has been discovered that in a diaphragm type transducer, it is desirable to have the higher frequency audio sounds emanate from a narrow and long strip like zone or area of the vibrating diaphragm. If the strip transducer is oriented in an upright position, the higher frequency audio sounds will emanate horizontally in substantially all directions resulting in a more uniform distribution of the audio signal. Sound attenuates only 3 dB for each doubling of distance instead of 6 dB as in conventional point source speakers. This provides for more consistent coverage and minimizes lost acoustic power.

Lower audible frequencies on the other hand do not tend to be as directional as the higher frequencies and can either be handled with a planar speaker or a separate more conventional point source speaker with no loss in performance.

U.S. Pat. No. 3,919,499 (incorporated herein by reference) (Nov. 11, 1975) discloses a planar film speaker composed of planar zones where each zone may have a separate circuit for reproducing a different spectrum of the audio signal.

U.S. Pat. No. 4,037,061 (incorporated herein by reference) (Jul. 19, 1977) discloses a mechanical structure which permits a rapid and relatively simple assembly where the tolerances are automatically obtained as a result of the transducer design.

U.S. Pat. No. 3,919,499 (incorporated herein by reference) is believed to be the closest prior art. However, it differs from this invention in that the different line circuits for reproducing different audio spectrum are in separate structures or locations which can require a larger physical structure or result in a larger aperture which may diminish the speaker's "sweet spot" area of audio sound reproduction.

SUMMARY OF THE INVENTION

The main aspect of this invention is to create electrically separate line trace runs which occupy the same area on the vibrating film with the intention of driving the separate trace runs with different spectral components of the input signal. By having the separate line runs occupy the same area, the line source nature of the speaker is achieved with excellent frequency response.

One of the drawbacks of a planar line source speaker is that the higher frequencies above 10,000 to 20,000 Hz are somewhat rolled off (not as loud) in comparison to the lower frequencies. Also, there is typically some amplitude peaking in the mid audio range. This peaking must be eliminated by a notch filter which attenuates the input signal in the frequency range of the peaking. One aspect of this invention is to improve the audio output frequency response in a simple and economical manner while preserving the line source characteristics of the transducer.

A line trace circuit is a single continuous conductor mechanically mounted to the vibrating film. In the prior art, multiple sets of line trace circuits have been used to reproduce different audio spectrums. The different circuits have been physically separated. In some cases, the structure of the speaker is different in the areas of the different line traces complicating the design and also resulting in different parts of the signal spectrum emanating from separate line acoustical radiation sources. For example, the spacing between the vibrating film and the magnet structure may be different in the two areas. Another aspect of this invention is to implement separate line trace circuits but to allow the circuits to be physically close so as to have similar audio spatial and dispersion outputs for the different frequency ranges.

It is also known that the larger the vibrating panel width, the smaller will be the audio sound dispersion angle. It is also an aspect of this invention to keep the width of the vibrating source as narrow as possible in order to better approximate a true line source with its improved dispersion angle.

Other aspects of this invention will appear from the following description and appended claims, reference being made to the accompanying drawings forming a part of this specification wherein like reference characters designate corresponding parts in the several views.

DETAILED DESCRIPTION OF THE DRAWINGS

Figure 1:
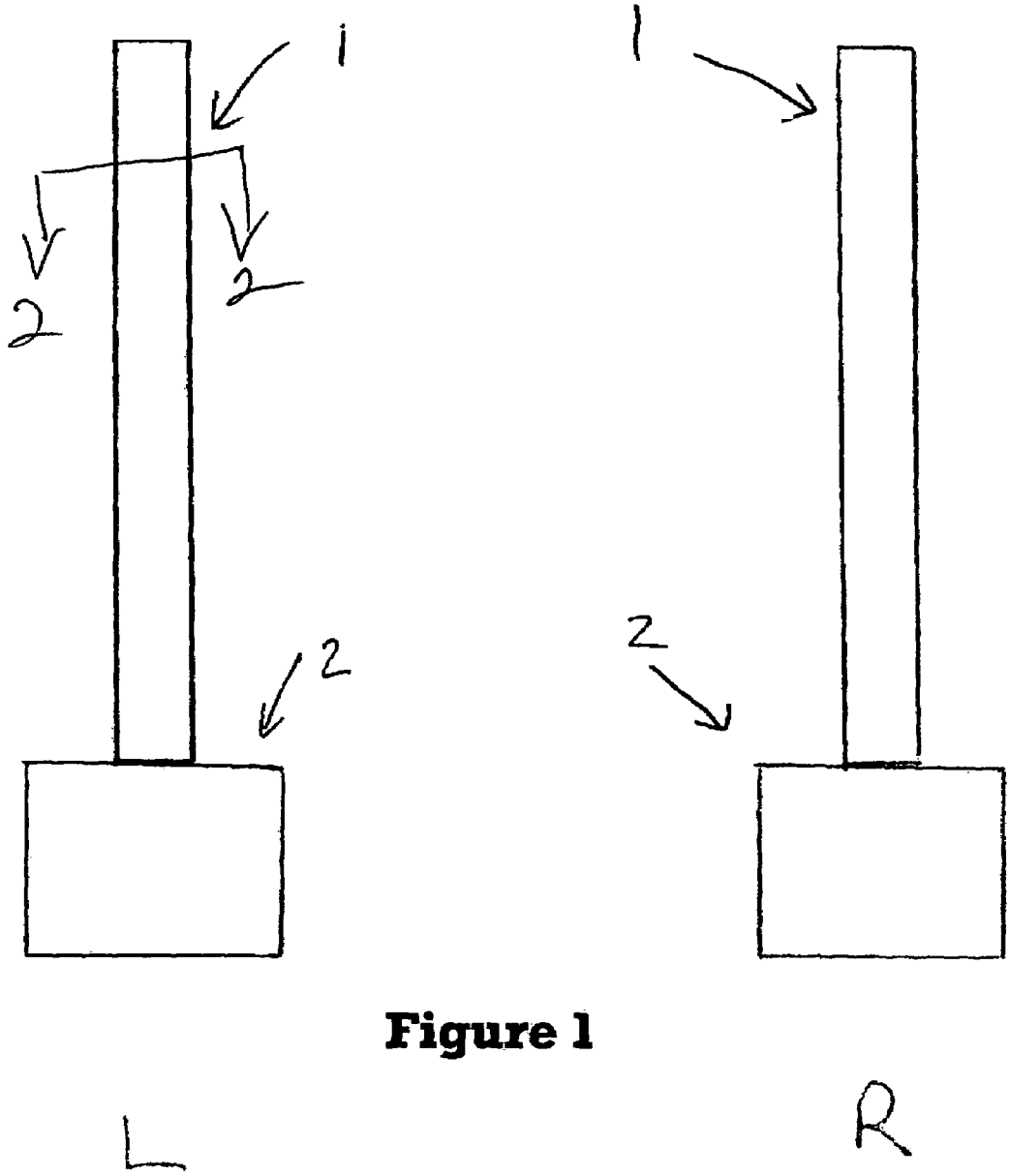
FIG. 1 is a front plan view representation of a stereo speaker system.

Referring to FIG. 1, a typical planar line source stereo speaker system is shown where 1 is the planar line source speaker and 2 is a conventional point source speaker used to enhance the low frequency response only.

In this figure, there are two sets L and R of transducers 1 and 2 in order to reproduce stereo audio. The length of the typical planar speaker 1 is typically from 40 inches to 75 inches tall and the sound aperture may only be on the order of 1 to 2 inches in order to best approximate a true acoustical line source. There is no limitation on the size or dimensions of the transducers.

Figure 2:
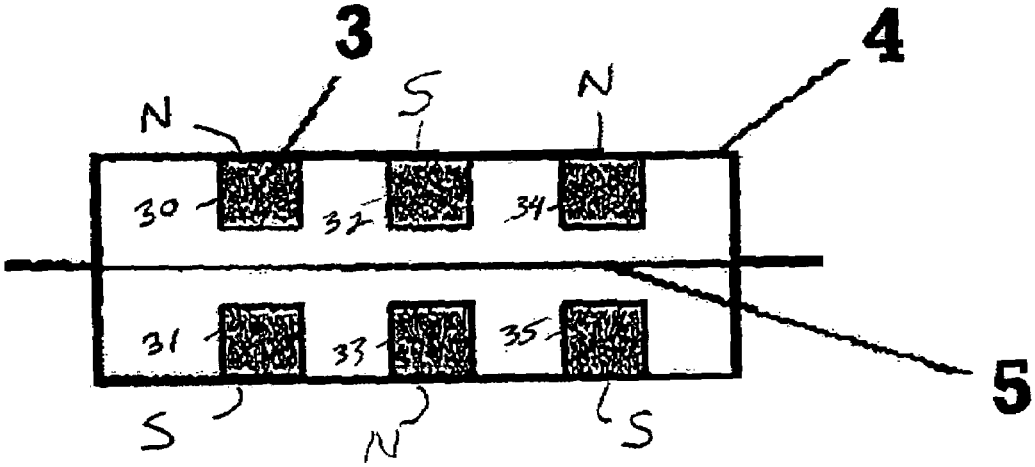
FIG. 2 is an end sectional view of a planar speaker taken along line 2—2 of FIG. 1.

Referring to FIG. 2, an end view of a typical planar speaker is shown. The magnet structure 3 is set up as sets of north/south magnet pairs 30 and 31, 32 and 33, 34 and 35 repelling each other from the top to the bottom magnet and also with alternating polarity in the dimension along the stretched film 5. The framework 4 holds the magnets in place and also holds and stretches the film 5 on all four sides. The framework 4 can also hold the film 5 on only two sides in some applications. The magnets of magnet structure 3 are generally of a bar shape and can be composed of Ceramics, Neodymium (a rare earth) or other suitable magnetic materials.

Figure 3:
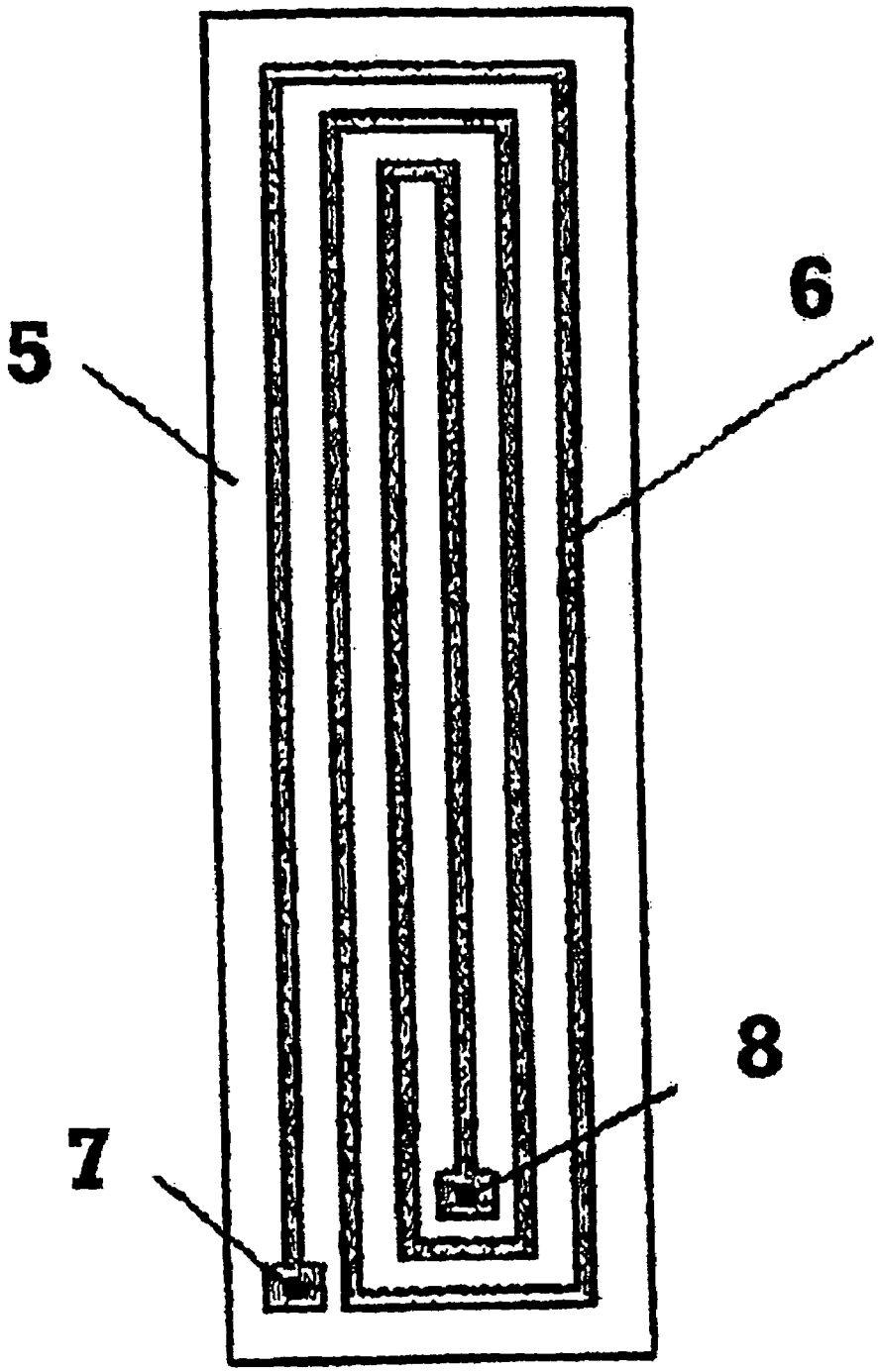
Figure 3 (PRIOR ART)
FIG. 3 is a prior art front plan view of the circuit run trace of a planar speaker.

FIG. 3 is the planar film and structure for a prior art planar film speaker. 5 is the film which typically may be 0.3 millimeters thick and can be composed of Mylar, Polyester, Kapton or other materials. 6 is the electrical current carrying trace which is typically 0.3 millimeters thick and 3/16 inch wide and can vary in both thickness and width depending on the impedance desired. 7 is the positive connection terminal for the electrical current, and 8 is the negative connection terminal. The trace run specifically shown in the figure is referred to as a "six turn run" as the trace traverses the total length of the film six times in one continuous run. This prior art configuration has the drawback of producing less acoustical energy in the higher frequency audible range.

Figure 4:
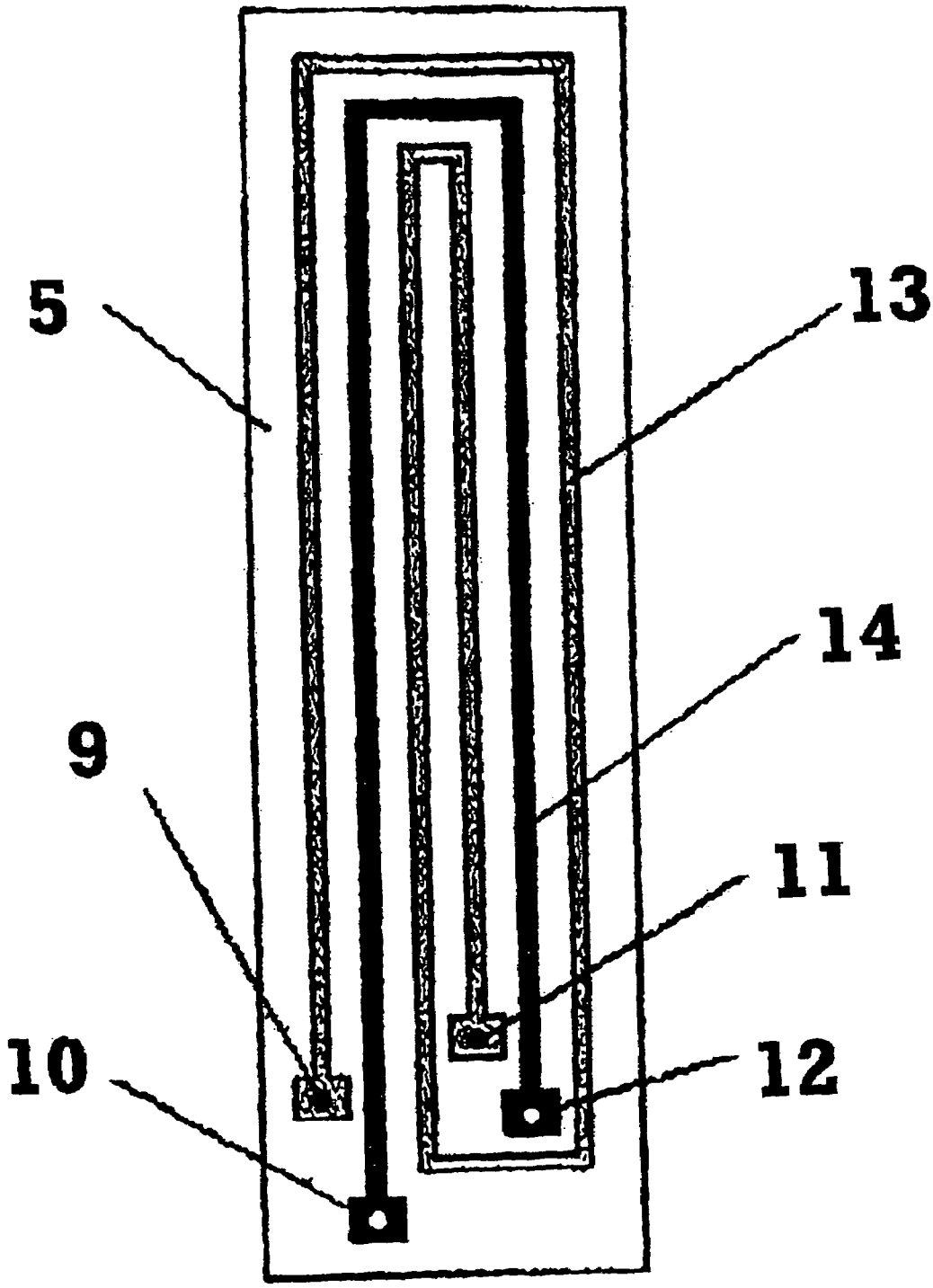
FIG. 4 is a front plan view of the trace runs of the preferred embodiment.

FIG. 4 is one embodiment of the invention in which there are two electrically separate trace runs essentially occupying the same area of the film. In this case, one continuous run transverses the length of the film four times ("four run") and the other only two times ("two run"). 13 is the four run trace and 14 is the two run trace. 9 is the positive terminal for the two run trace and 10 is the positive terminal for the two run trace. 11 is the negative terminal for the four run trace and 12 is the negative terminal for the two run trace. Other trace run configurations of either multiple independent circuits or different numbers of runs per trace can also be implemented depending on the desired results of impedance and frequency response.

Figure 5:
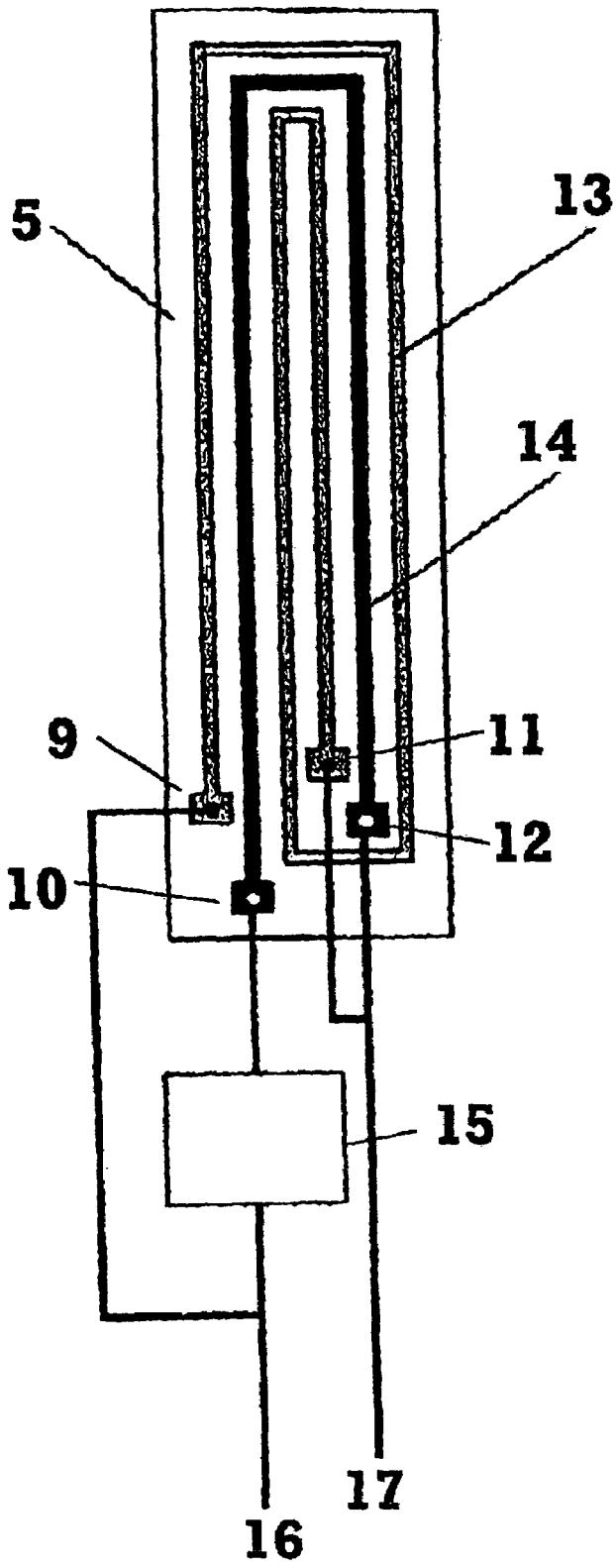
FIG. 5 is the same as FIG. 4 with the addition of a frequency crossover circuit hookup.

FIG. 5 is an embodiment of the invention including a frequency selective network 15. 16 is the positive input from the power amplifier, and 17 is the negative input from the power amplifier. In FIG. 5, the current from the power amplifier is applied directly to the four run trace 13 but goes through the frequency selective network before going through the two run trace 14. Therefore, the full frequency spectrum on the amplifier signal drives the four run circuit. The two run circuit 14, however, is driven through a frequency selective network 15 which in one case only passes frequencies above where the four run trace circuit begins to naturally fall off or produce less acoustical energy. In one application, the frequency selective network is a passive (no external power is applied) high pass filter which allows only the spectral energy above 5,000 to 6,000 Hz to be applied to the two run circuit. The frequency shaping of the frequency selective network can of course vary on both frequency and filter characteristics in order to achieve the desired results of impedance and acoustical frequency response.

Figure 6:
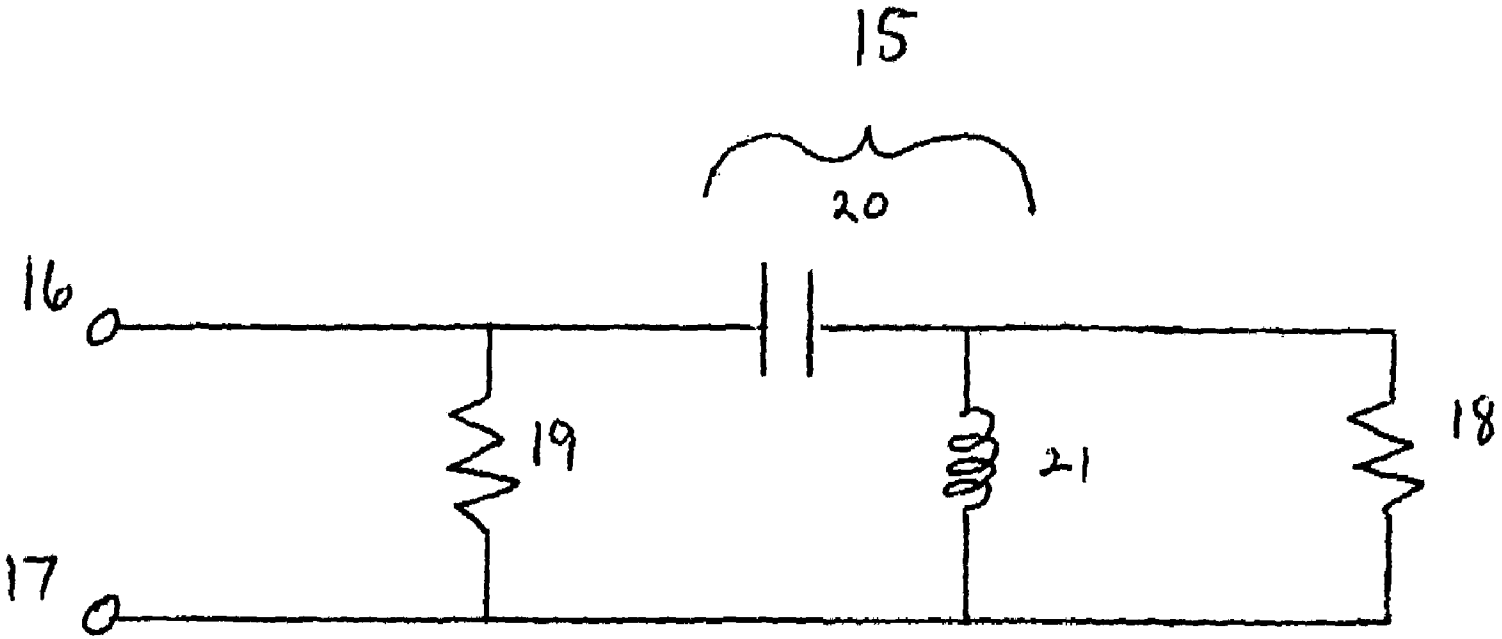
FIG. 6 is a circuit diagram including components for a passive crossover and lumped elements for the trace runs of the structure shown in FIG. 5.

FIG. 6 is an embodiment of the passive high frequency cross over network 15 along with a lumped element representation of the two and four line trace planar transducer. 19 is the lumped impedance of the four line trace 13 and 18 is the lumped impedance of the two line trace 14. All component values can vary depending on the type of filter characteristics and impedance's desired, however, a typical value for the inductor 21 is 0.044 mHenry, and the typical value for the capacitor 20 value is 10 or 12 uFarad. The filter topology will change for other types of filters such as bandpass or lowpass.

In this embodiment, the frequency peaking at 5 Khz to 6 Khz of the single continuous prior art configuration is eliminated in the four run circuit 13 by having the extra frequency dependent impedance of the crossover circuit become significant in the region where the frequency peaking occurred. By driving the additional two run circuit 14 with only the higher frequencies, overall acoustic energy frequency flatness is achieved, and the audio energy exhibits the line source output with both a small aperture and constant radiation characteristics over the desired spectral energy range.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A planar line source speaker comprising:

a magnet pair having a space between a first and a second member of the magnet pair;

a vibratable film mounted across the space;

a first line trace circuit mounted on a one side of the vibratable film;

a second line trace circuit mounted on the one side of the vibratable film;

wherein the second line trace circuit occupies essentially a same area of the vibratable film as the first line trace circuit without overlapping the first line trace circuit;

wherein the first line trace circuit is driven with a first spectral component of an audio input signal and the second line trace circuit is driven with a second spectral component of the audio input signal;

wherein the first line trace circuit is a four run trace, and the second line trace circuit is a two run trace;

wherein the first line trace circuit is rectangular, and the second line trace circuit is rectangular having a size to fit inside a boundary of the first line trace circuit; and wherein the first line trace circuit is connected directly to a power amplifier and the second line trace circuit is connected to the power amplifier via a filter subsystem, the filter subsystem functioning to only pass frequencies above where the first line trace circuit begins to naturally fall off.

2. The apparatus of claim 1, wherein the filter subsystem further comprises a passive high pass filter which allows only a spectral energy above a range of about 5000 to 6000 Hz to be applied to the second line trace circuit.

3. A sound generating transducer comprising:

a framework having a magnet structure with opposing pairs of magnets defining a space therebetween;

an audio sound-producing flexible diaphragm secured to the framework and defining a vibratable area in the space;

edges of the vibratable area being stationary against vibration with respect to the framework, the vibratable area of the flexible diaphragm having a central portion with low and high frequency signal carrying conductive means thereon for vibrating the entire vibratable area;

said low and high frequency signal carrying conductive means further comprising a first line trace circuit mounted on a one side of the flexible diaphragm and a second line trace circuit mounted on the one side of the flexible diaphragm;

wherein the second line trace circuit occupies essentially a same area of the flexible diaphragm as the first line trace circuit without overlapping the first line trace circuit;

wherein the first line trace circuit is driven with a first spectral component of an audio input signal and the second line trace circuit is driven with a second spectral component of the audio input signal;

wherein the first line trace circuit is a four run trace, and the second line trace circuit is a two run trace;

wherein the first line trace circuit is rectangular, and the second line trace circuit is rectangular having a size to fit inside a boundary of the first line trace circuit; and wherein the first line trace circuit is connected directly to a power amplifier and the second line trace circuit is connected to the power amplifier via a filter subsystem, the filter subsystem functioning to only pass frequencies above where the first line trace circuit begins to naturally fall off.

4. The apparatus of claim 3, wherein the filter subsystem further comprises a passive high pass filter which allows only a spectral energy above a range of about 5000 to 6000 Hz to be applied to the second line trace circuit.

5. A sound generating transducer comprising:

an audio frequency electric signal from an audio frequency electric signal amplifier;

a vibratable diaphragm mounted in a framework between at least one pair of magnets;

said vibratable diaphragm having a first and a second line trace circuit mounted thereon;

wherein the first line trace circuit and the second line trace circuit are mounted on a common side of the vibratable diaphragm;

wherein the second line trace circuit occupies essentially a same area of the vibratable diaphragm as the first line trace circuit without overlapping the first line trace circuit;

wherein the audio frequency electric signal is connected to the first line trace circuit;

wherein the audio frequency electric signal is connected to the second line trace circuit via a filter subsystem;

wherein the first line trace circuit is a four run trace, and the second line trace circuit is a two run trace;

wherein the first line trace circuit is rectangular, and the second line trace circuit is rectangular having a size to fit inside a boundary of the first line trace circuit; and wherein the filter subsystem further comprises a frequency selective network means functioning to only pass frequencies above where the first line trace circuit begins to naturally fall off.

6. The apparatus of claim 5, wherein the frequency selective network means further comprises a passive high pass filter which allows only a spectral energy above a range of about 5000 to 6000 Hz to be applied to the second line trace circuit.

* * * * *